US006247642B1

(12) United States Patent
Wilson, Jr.

(10) Patent No.: US 6,247,642 B1
(45) Date of Patent: Jun. 19, 2001

(54) SECURITY MAIL BOX

(76) Inventor: Lewis Wilson, Jr., 2017 Mockingbird Rd., Columbia, SC (US) 29204

( * ) Notice: Subject to any disclaimer, the term of this patent is extended or adjusted under 35 U.S.C. 154(b) by 0 days.

(21) Appl. No.: 09/390,760

(22) Filed: Sep. 7, 1999

(51) Int. Cl.[7] ..... B65G 11/04
(52) U.S. Cl. ..... 232/47; 232/17; 232/43.1
(58) Field of Search ..... 232/47, 43.1, 17, 232/45, 33

(56) References Cited

U.S. PATENT DOCUMENTS

| | | | |
|---|---|---|---|
| 516,890 | * | 3/1894 | Hentz . |
| 1,432,843 | | 10/1922 | Dooley . |
| 2,760,721 | * | 8/1956 | Roberts . |
| 3,515,337 | * | 6/1970 | Bornus . |
| 4,037,780 | | 7/1977 | Brownlee et al. . |
| 4,333,603 | | 6/1982 | Carlson . |
| 4,361,271 | | 11/1982 | Hester et al. . |
| 4,488,677 | * | 12/1984 | Guest, Sr. . |
| 4,844,332 | * | 7/1989 | Long . |
| 4,934,592 | * | 6/1990 | DiMenichi . |
| 4,993,626 | * | 2/1991 | Berry . |
| 5,071,063 | * | 12/1991 | Overstreet . |
| 5,096,115 | * | 3/1992 | Hassan . |
| 5,137,212 | * | 8/1992 | Fiterman et al. . |
| 5,143,284 | | 9/1992 | Socarras . |
| 5,148,974 | | 9/1992 | Clapper . |
| 5,435,484 | * | 7/1995 | Carlson . |
| 5,526,979 | * | 6/1996 | Mann . |
| 5,597,116 | * | 1/1997 | Morris . |
| 5,938,113 | * | 8/1999 | Kim . |

* cited by examiner

*Primary Examiner*—Lynne H. Browne
*Assistant Examiner*—William L. Miller
(74) *Attorney, Agent, or Firm*—Henderson & Sturm LLP

(57) ABSTRACT

A mail box construction including a security compartment housed beneath a regular conventional mail compartment. The bottom of the conventional portion of the mail box is formed by an extension of a hinged door which is in a substantially horizontal position when the mail box door is opened and which lowers into a declined position when the mail box door is completely closed. When the door closes the mail drops into a locked safety compartment for later retrieval. An outgoing mail shelf is carried on a sidewall of the conventional mail compartment.

1 Claim, 1 Drawing Sheet

SECURITY MAIL BOX

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to the field of mail boxes, and more particularly to a security mail box.

2. Description of the Related Art

As can be seen by reference to the following U.S. Pat. Nos. 1,432,843; 4,037,780; 4,333,603; 4,361,271; 5,143,284 and 5,148,974 the prior art is replete with myriad and diverse security mail boxes.

While all of the aforementioned prior art constructions are more than adequate for the basic purpose for which they have been specifically designed, they are uniformly deficient with respect to their failure to provide a simple, efficient and practical security mail box.

As a consequence of the foregoing situation, there has existed a need for a new and improved security mail box and the provision of such a construction is a stated objective of the present invention.

BRIEF SUMMARY OF THE INVENTION

Briefly stated, the present invention provides a mail box construction including a security compartment housed beneath a regular conventional mail compartment. The bottom of the conventional portion of the mail box is formed by an extension of a hinged door which is in a substantially horizontal position when the mail box door is opened and which lowers into a declined position when the mail box door is completely closed. When the door closes the mail drops into a locked safety compartment for later retrieval. An outgoing mail shelf is carried on a sidewall of the conventional mail compartment.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
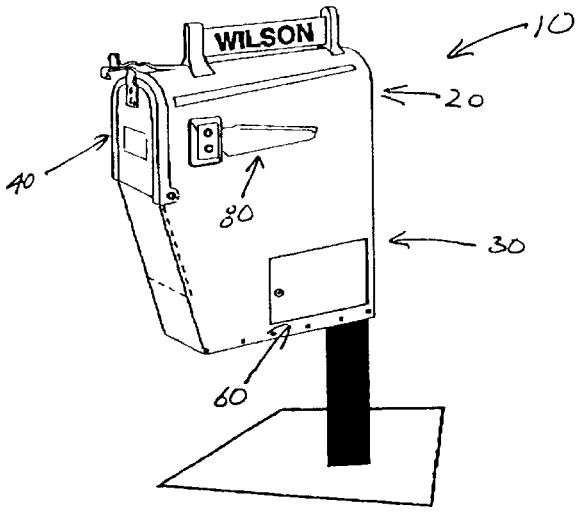
FIG. 1 is a perspective view of the security mail box of the present invention.
Figure 2:
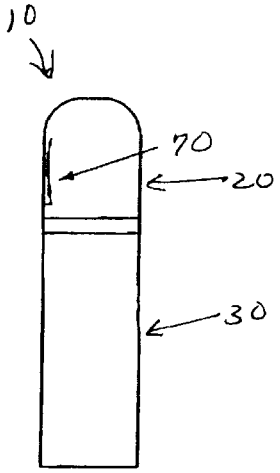
FIG. 2 is a front elevational sectional view thereof.
Figure 3:
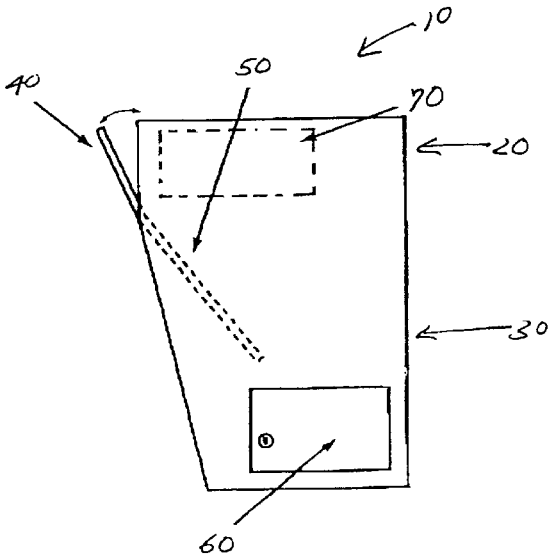
FIG. 3 is a side elevational view thereof showing the door near the closed position.
Figure 4:
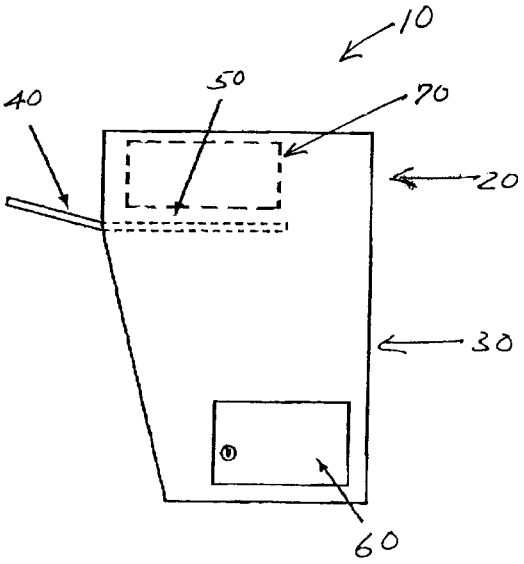
FIG. 4 is a side elevational view thereof showing the door in the open position.

As can be seen by reference to the drawings, and in particulary to FIG. 1, the security mail box that forms the basis of the present invention is designated generally by reference number (10). The mail box (10) has a housing including an upper section (20) and lower security section (30). The upper section (20) resembles a conventional mail box and includes a hinged access door (40) having an angularly disposed floor extension (50). The floor extension (50) supports incoming mail when the door (40) is opened (FIG. 4), and it declines to deposit mail into the lower security section (30) when the door (40) is closed (FIG. 3). Mail is retrieved from the lower security section (30) through a locked water-tight access door (60).

The interior sidewall of the upper section (20) carries an outgoing mail shelf (70), and an indicator flag (80) is mounted at the exterior sidewall. Access to the upper section (20) is provided through the hinged door (40). Outgoing mail may be placed on the shelf (70) inside the mail box (10) and the flag (80) may be raised to signal the carrier to pick up the mail. Incoming mail is placed in the floor extension (50) which is in the horizontal position (FIG. 4) when the door (40) is opened. When the door (40) is opened, it is impossible to reach into the lower security section (30) through the door (40) to remove the contents since the floor extension (50) blocks access. Mail may be retrieved only through the locked access door (60).

The security mail box (10) provides a secure environment for mail and prevents theft as well as water damage. Important information such as bank statements, credit card numbers, and other private correspondence are protected.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. A security mail box, consisting of:

a housing including an upper section having an access opening and a lower security section having a mail retrieval opening;

an access door pivotally attached to the housing adjacent the access opening and being movable between a raised closed position and a lowered open position;

a floor extension rigidly and directly attached to and extending in from the access door, the floor extension being movable between a declined position when the access door is moved to the closed position, and a horizontal position when the access door is moved to the open position;

a lockable security door disposed over the mail retrieval opening;

an outgoing mail shelf mounted within the upper section of the housing;

an indicator flag attached to an exterior surface of the upper section of the housing;

wherein the access door is angularly disposed and non-parallel with respect to the floor extension; and wherein the outgoing mail shelf is mounted on an interior vertical sidewall of the upper section of the housing.

* * * * *